US006716068B2

(12) United States Patent
Wu

(10) Patent No.: US 6,716,068 B2
(45) Date of Patent: Apr. 6, 2004

(54) LOW PROFILE ELECTRICAL CONNECTOR HAVING IMPROVED CONTACTS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/194,121

(22) Filed: Jul. 11, 2002

(65) Prior Publication Data

US 2003/0119366 A1 Jun. 26, 2003

Related U.S. Application Data

(63) Continuation-in-part of application No. 10/028,656, filed on Dec. 20, 2001, now Pat. No. 6,572,385.

(51) Int. Cl.[7] ..... H01R 13/40
(52) U.S. Cl. ..... 439/733.1; 439/633
(58) Field of Search ..... 439/636, 637, 439/567, 59–62, 92–108, 733.1, 752.5

(56) References Cited

U.S. PATENT DOCUMENTS 5,989,064 A * 11/1999 Harlan et al. ..... 439/567
6,019,639 A * 2/2000 Brunker et al. ..... 439/637
6,071,152 A * 6/2000 Achammer et al. ..... 439/733.1
6,174,187 B1 * 1/2001 Yamagami et al. ..... 439/326
6,350,152 B1 * 2/2002 Belopolsky et al. ..... 439/541

* cited by examiner

*Primary Examiner*—Alexander Gilman
(74) *Attorney, Agent, or Firm*—Wei Te Chung

(57) ABSTRACT

An electrical connector (10) includes an insulative housing (20) having a mating face (21) and a mounting face (22) and a plurality of contacts (30, 40). Two receiving slots (26) are defined between the mating face and the mounting face. A plurality of passageways (24) are defined in the housing and communicate with the receiving slots. The contacts are arranged into the passageways. Each contact comprises a contact portion (301, 401) received in the passageway and partly exposed in the slot, a first mounting portion (303, 403) fixed within the housing, a second mounting portion (306, 406) offset the first mounting portion and fixed with the housing, a bending portion (304, 404) having a first part bent toward the contact portion and a second part connecting with the second mounting portion, and tail portion (306, 406) extending downwardly from the second mounting portion.

19 Claims, 7 Drawing Sheets

LOW PROFILE ELECTRICAL CONNECTOR HAVING IMPROVED CONTACTS

CROSS-REFERENCE TO RELATED APPLICATION

This patent application is a CIP (Continuation-in-Part) of the co-pending application of patent application Ser. No. 10/028,656, U.S. Pat. No. 6,572,385 entitled "LOW PROFILE ELECTRICAL CONNECTOR", filed on Dec. 20, 2001, invented by the same inventor as this patent application and assigned to the same assignee.

BACKGROUND OF THE INVENTION

1. Field of the Invention

The present invention relates to a low profile electrical connector, and more particularly to a low profile electrical connector having improved contacts.

2. Description of Related Art

An organization, named Serial Advanced Technology Attachment (SATA) Working Group released a specification defining the SATA interface. The interface is used to connect storage devices such as hard disk, DVD and CD-ROM drives to a PC motherboard. The specification defines a first type SATA connector connected with a cable and a second type SATA connector mounted on a printed circuit board (PCB).

The second type SATA connector defined by the specification includes an insulative housing and a plurality of contacts. The contacts are retained in the housing and partly extend out of the housing for electrically connecting with the PCB. For simplifying the mounting process of the SATA connector to the PCB, the SATA connector is provided with press-fit contacts which have needle-eyed tails for being forcibly fitted into metal plated through holes of the PCB.

Please referring to FIG. 9, an SCA 2 connector 8 described in U.S. Pat. No. 6,312,296 is shown. The connector 8 is provided with press-fit contacts 80. The contacts 80 each comprise a mating portion 82 on an upper end thereof for electrically connecting with a contact of a mating connector and a needle-eyed pin 84 on a lower end thereof for insertion into a PCB. The mating portion 82 includes a transverse portion 820 horizontally extending from an upper end of the needle-eyed pin 84 and is substantially perpendicular to the needle-eyed pin 84, and a retaining beam 822 extending upwardly from the transverse portion 820.

The contacts of the '296 patent cannot be used in the SATA connector, because the contacts are too high to meet the low profile requirement. It is necessary to devise a new press-fit contact which can be used in the low profiled SATA connector and which has a length long enough to obtain the required bulk resistance meeting the predetermined impedance of an interconnecting system including the SATA connector.

SUMMARY OF THE INVENTION

Accordingly, a major object of the present invention is to provide a low profiled electrical connector having improved press-fit contacts mounted therein.

Another object of the present invention is to provide a low profiled electrical connector having improved press-fit contacts each of which has a length sufficiently long to have a bulk resistance meeting the predetermined impedance of an interconnecting system including the connector, and has retention means which can reliably and securely fasten the contacts to an insulative housing of the connector.

To obtain the above objects, an electrical connector in accordance with the present invention comprises an insulative housing and a plurality of contacts. The housing includes a base portion having a mounting face and a mating portion connecting with the base portion and having a mating face. Two receiving slots are defined between the mounting face and the mating face. A plurality of passageways are defined in the housing and communicate with the receiving slots. The contacts are arranged in the passageways. Each contact comprises a contact portion received in the passageway and partly exposed in the slot, a first mounting portion connecting with the contact portion and fixed within the base portion, a second mounting portion offset with the first mounting portion and fixed to the base portion, a bending portion having a first part bent toward the contact portion and a second part connecting with the second mounting portion, and a tail portion connecting with the second mounting portion.

Other objects, advantages and novel features of the invention will become more apparent from the following detailed description of the present embodiment when taken in conjunction with the accompanying drawings.

DETAILED DESCRIPTION OF THE INVENTION

An electrical connector for mounting to a printed circuit board generally comprises an insulative housing defining a plurality of passageways for receiving and retaining a plurality of conductive contacts therein. The contacts are designed to meet certain requirements of mechanical and electrical performances. FIGS. 1–8 of the attached drawings show a serial advanced technology attachment (SATA) electrical connector having contacts constructed in accordance with the present invention. The following description of the contacts of the present invention is illustrative only, not to restrict the use and application of the contacts. The contacts can also be used in low profiled electrical connectors of other types.

Figure 1:
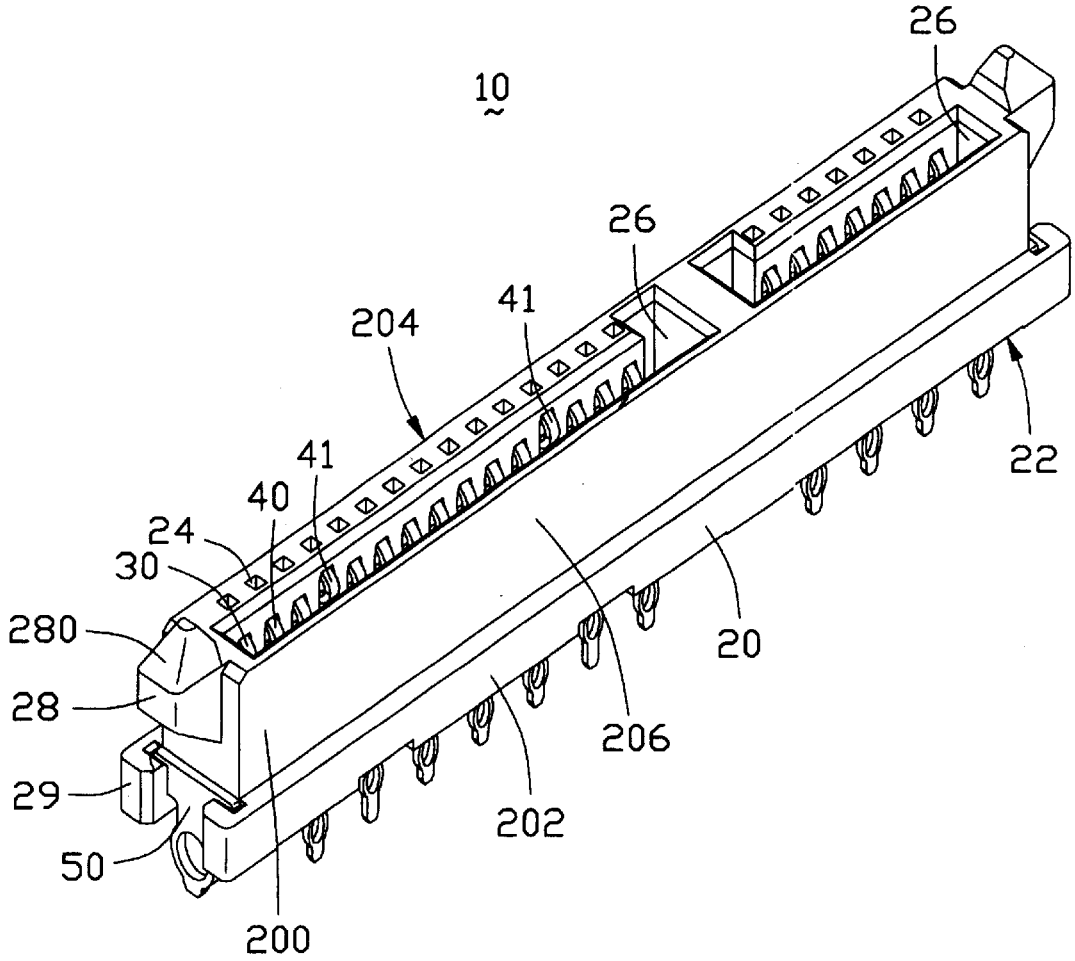
FIG. 1 is a perspective view of an electrical connector in accordance with the present invention.
Figure 2:
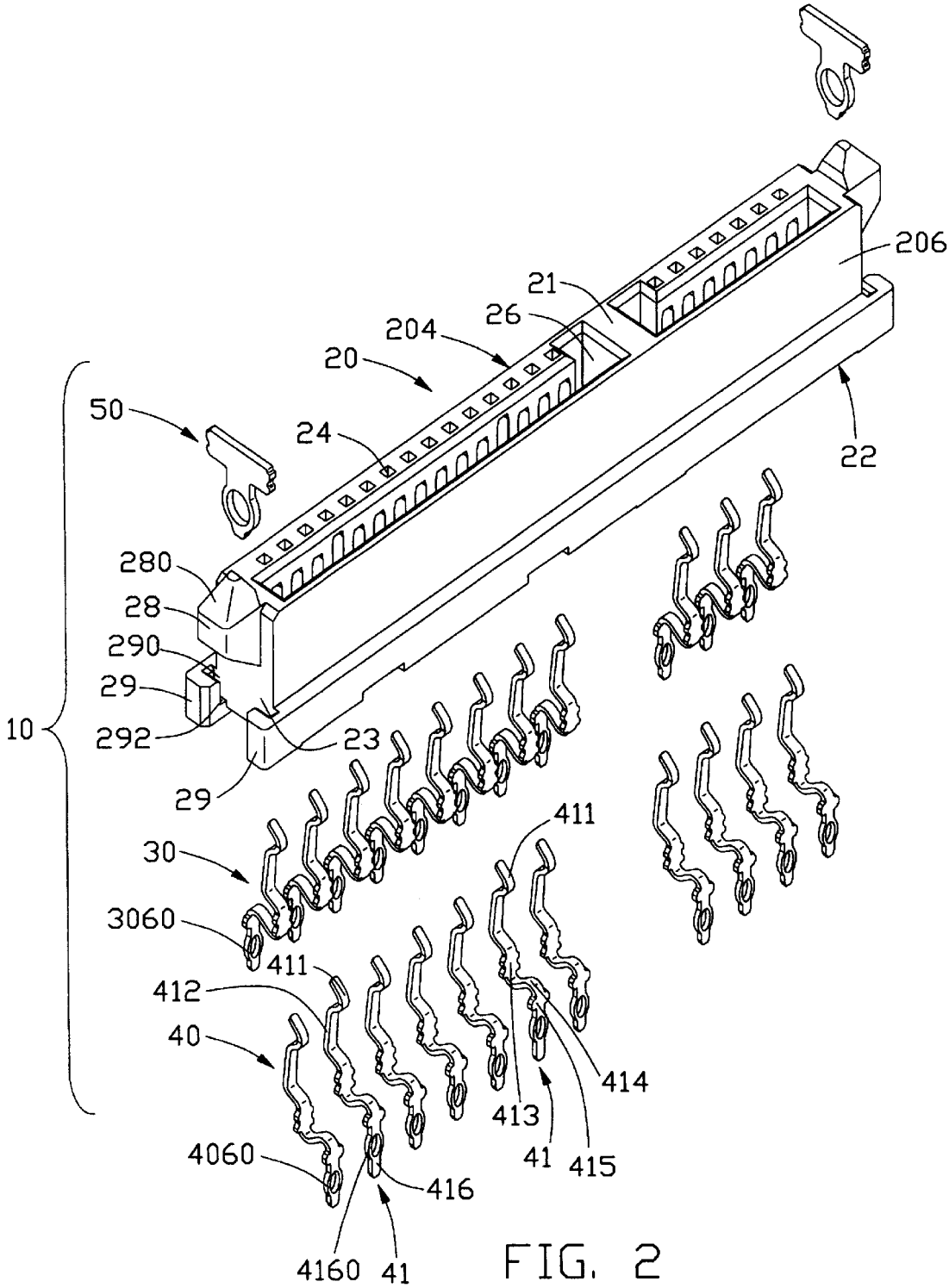
FIG. 2 is an exploded perspective view of the connector of FIG. 1.
Figure 3:
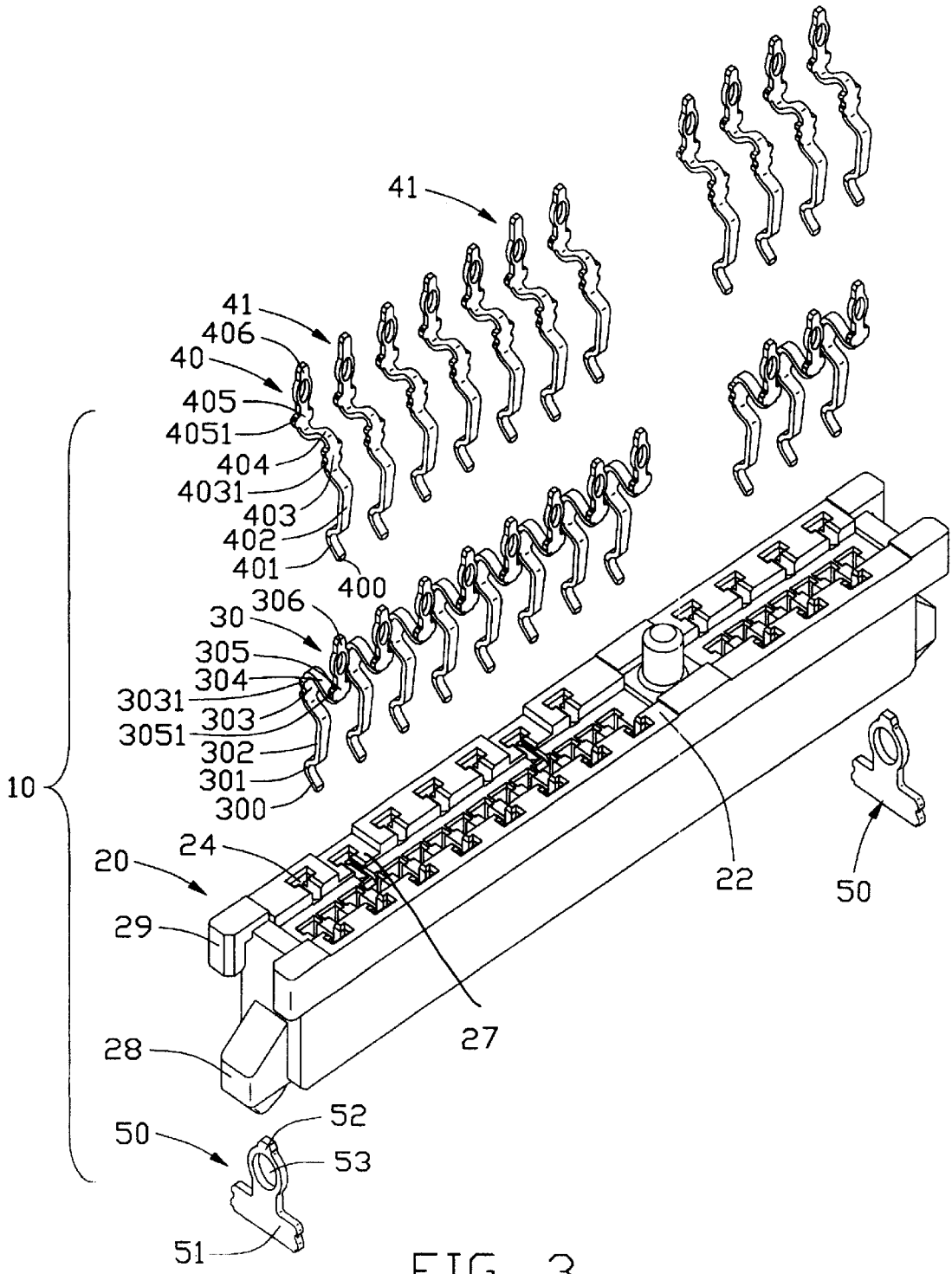
FIG. 3 is a view similar to FIG. 2, but from a bottom aspect.
Figure 4:
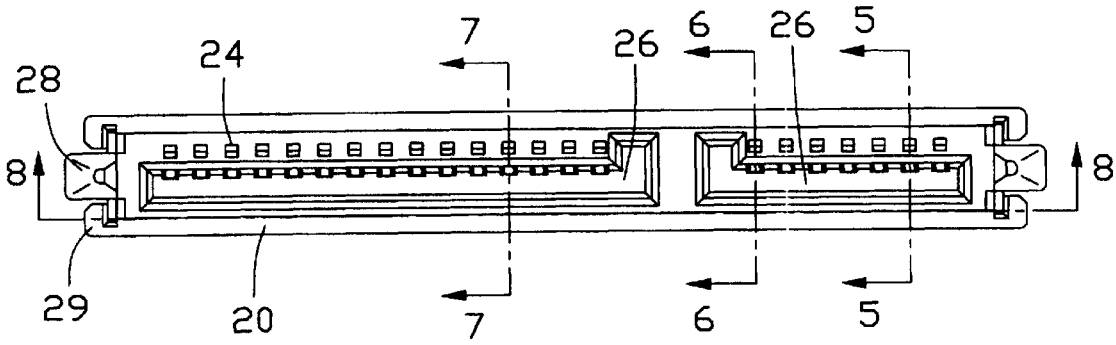
FIG. 4 is a top plan view of the connector of FIG. 1.

Referring to FIGS. 1–3, an electrical connector 10 in accordance with the present invention comprises an insulative housing 20, a plurality of first contacts 30, a plurality of second contacts 40 and a pair of board locks 50. The electrical connector 10 is designed to be mounted to a printed circuit board (PCB, not shown).

The housing 20 comprises an elongated mating portion 200 and an elongated base portion 202. The mating portion 200 has a mating face 21 and a pair of side walls 204 and 206. The base portion 202 has a mounting face 22. Two receiving slots 26 are defined between the mating face 21 and the mounting face 22. One slot 26 is longer than the other. The side wall 204 is thicker than the other side wall 206 and the side wall 204 defines a plurality of passageways 24 communicating with the receiving slots 26. The receiving slots 26 are devised for receiving a complementary plug connector (not shown) whereby the connector 10 and the complementary connector are electrically connected together.

The housing 20 provides a pair of guiding blocks 28 laterally protruding from respective side faces of the housing 20. The guiding blocks 28 are located adjacent to the mating face 21 and each have a tapered section 280 upwardly extending beyond the mating face 21 for guidance of the connector 10 to mate with the complementary connector. The housing 20 further provides a pair of retention portions 29 at lateral ends 23 of the housing 20 adjacent to the mounting face 22. The retention portions 29 are located under the respective guiding blocks 28 and a groove 290 is defined in each of the retention portions 29. A step 292 is located on a bottom of the groove 290.

The first and second contacts 30, 40, best shown in FIG. 2 and FIG. 3, are similar in shape, and each includes a free end 300 (400), a contact portion 301 (401), a spring arm 302 (402), a first mounting portion 303 (403) downwardly extending from the spring arm 302 (402), a second mounting portion 305 (405) offset from the first mounting portion (303) 403, a bending portion 304 (404) connecting the first mounting portion 303 (403) with the second mounting portion 305 (405), and a tail portion 306 (406) connecting with the second mounting portion 305 (405). A pair of first retention serrations 3031 (4031) protrude from a pair of sides of the first mounting portion 303 (403). A pair of second retention serrations 3051 (4051) protrude from a pair of sides of the second mounting portion 305 (405). The tail portion 306 (406) is a needle-eyed tail and comprises a pair of double supported cantilever beams 3060 (4060) that functions as a compliant zone for being pressed into a plated through hole (PTH) in the PCB.

The bending portion 304 (404) is generally S-shaped, which has a first part bent toward the contact portion 301 (401) and a second part connecting with the second mounting portion 305 (405). The S-shaped bending portions 304 of the first contacts 30 are opposite to the S-shaped bending portions 404 of the second contacts 40; in other words, the S-shaped bending portions 304 and the S-shaped bending portions 404 are respectively bent towards the two side walls 204, 206 of the housing 20.

Figure 8:
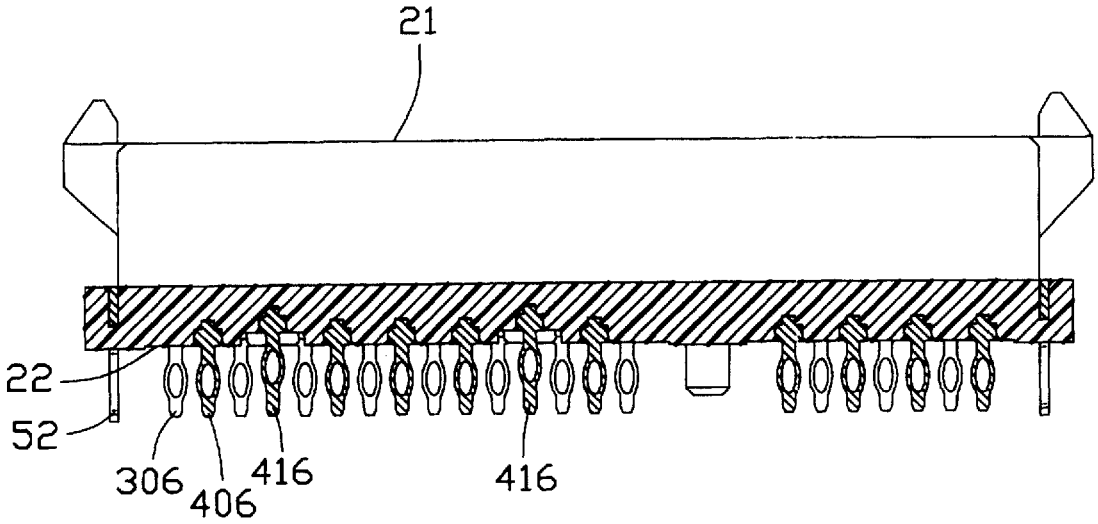
FIG. 8 is a cross-sectional view of the connector taken along line 8—8 of FIG. 4.
Figure 9:
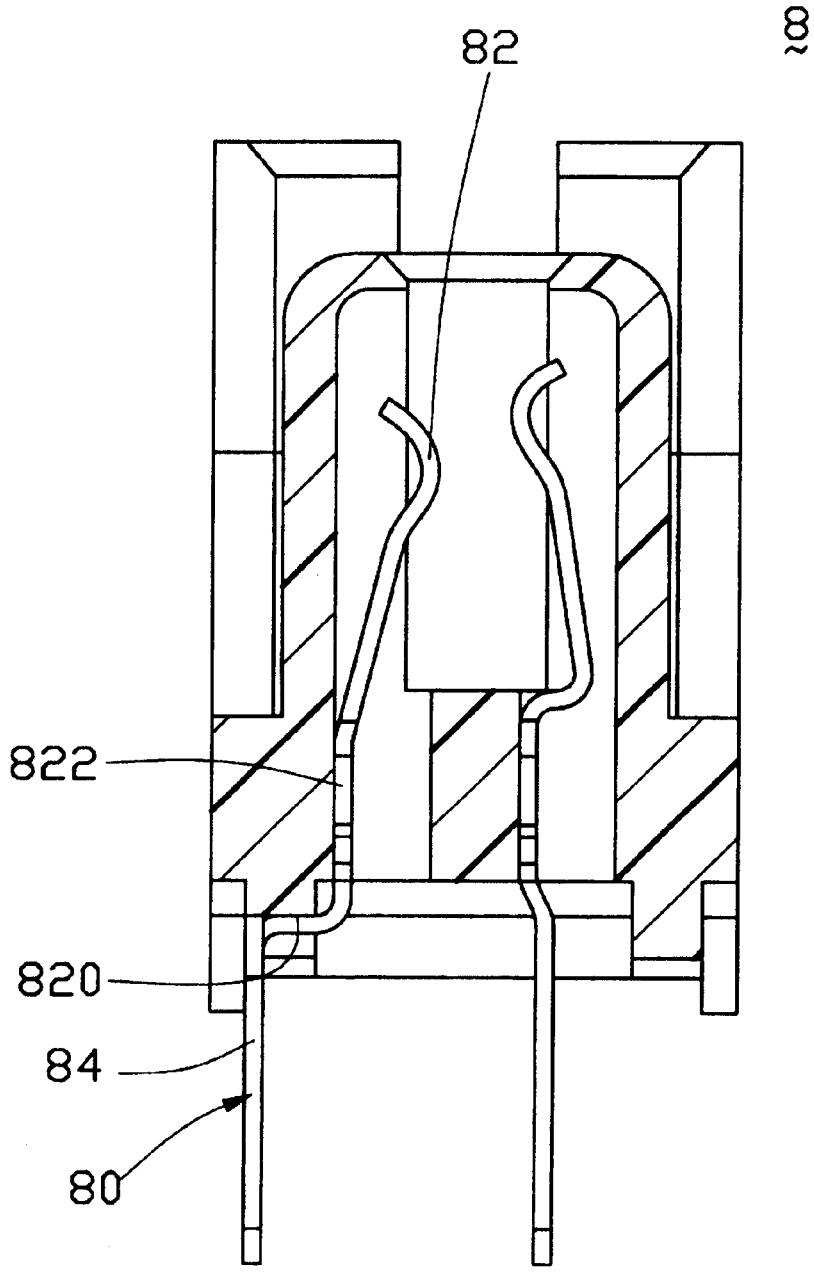
FIG. 9 (RELATED ART)
FIG. 9 is a cross-sectional view of an SCA 2 connector in accordance with U.S. Pat. No. 6,312,296.

The connector 10 further comprises grounding contacts 41 arranged in the signal/power contacts 40. The shape of the grounding contacts 41 is substantially similar to that of the signal/power contacts 40. Each grounding contact 41 has a free end 410, a contact portion 411, a spring arm 412, a first mounting portion 413, a S-shaped bending portions 414, a second mounting portion 415 and a tail portion 416. In the preferred embodiment according to the present invention, the connector 10 has two grounding contacts 41 each of which as best shown in FIG. 8 has the tail portion 416 longer than the tail portions 406 of the signal/power contacts 40. Understandably, similar to the parent application, the underside of the housing defines channels 27 (FIG. 3) for having the grounding contacts 41 located retreated positions above the underside to result in vertical raised offset from the signal contacts 40.

Figure 5:
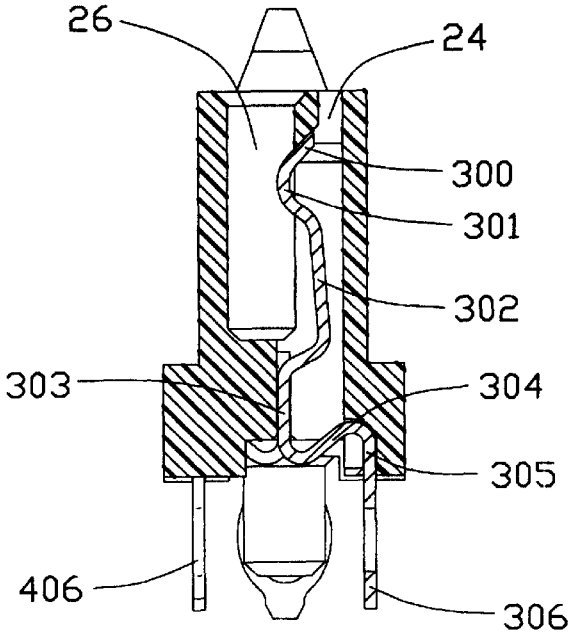
FIG. 5 is a cross-sectional view of the connector taken along line 5—5 of FIG. 4.
Figure 6:
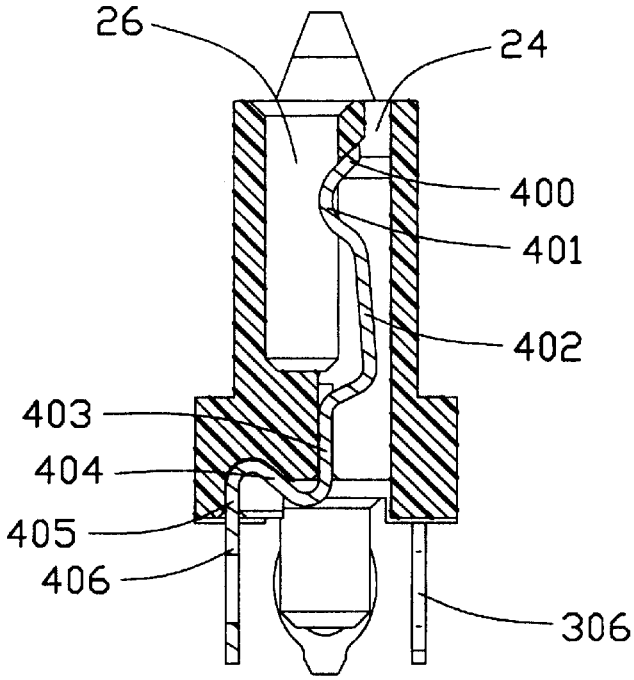
FIG. 6 is a cross-sectional view of the connector taken along line 6—6 of FIG. 4.

In assembly, the first and second contacts 30, 40 are alternately assembled into the passageways 24 from the mounting face 22. Referring to FIGS. 5–6, the first mounting portions 303, 403 provide a secure and stable retention of the contacts 30, 40 with the base portion 202 of the housing 20 because of the first retention serrations 3031, 4031 bite into the base portion 202 of the housing 20. The spring arms 302, 402 partially protrude into the receiving slot 26, the contact portions 301, 401 are exposed in the receiving slots 26 for mating with contacts of the complementary plug connector. The free ends 300, 400 rest on a portion of the insulative housing 20 near an inlet of the slot 26.

The S-shaped bending portions 304, 404 are also received in the passageways 24 and are exposed toward the adjacent mounting face 22 of the housing 20. Due to the second retention serrations 3051, 4051 engaging with the housing 20, the second mounting portions 305, 405 are reliably retained in the passageways 24. Understandably, because the S-shaped bending portion 304, 404 connects the first mounting portion 303, 403 with the second mounting portion 305, 405, the S-shaped bending portions 304, 404 are retained in the housing 20 securely. The needle-eyed tails 306, 406 extend downwardly from the second mounting portions 305, 405 beyond the mounting face 22 of the housing 20 for being pressed into the PTHs in the PCB.

Figure 7:
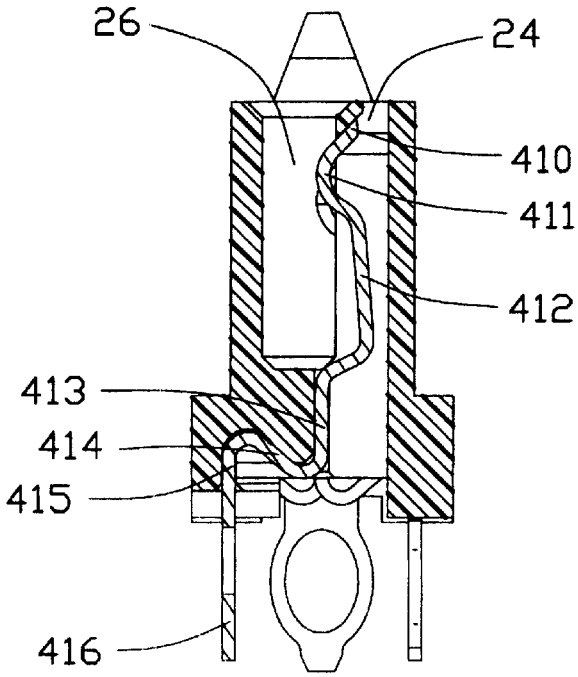
FIG. 7 is a cross-sectional view of the connector taken along line 7—7 of FIG. 4.

As mentioned above, in comparison with the signal/power contacts 40, each grounding contact 41 has a longer tail portion 416. As best shown in FIGS. 7–8, after the grounding contacts 41 are retained into the corresponding passageways 24, a distance between the contact portions 411 of the grounding contacts 41 and the mating face 21 of the housing 20 is shorter than a distance between the contact portions 401 of signal/power contacts 40 and the mating face 21. In other words, each contact portion 411 exposed in the passageways 24 is more adjacent to the mating face 21 than signal/power contact portions 301, 401. Thereby, the contact portions 411 of the grounding contacts 41 can firstly mate corresponding grounding contacts of a complementary connector to provide a grounding path before the signal/power contact portions 301, 401 electrically engage with corresponding contacts of the complementary connector. Understandably, the grounding path breaks last when the supplementary connector disconnects with the connector 10.

The pair of board locks 50, as best shown in FIGS. 2–3, is formed by stamping a metal plate to have a shape similar to that of the tail portions 306, 406 of the first, second contacts 30, 40. Each board lock 50 comprises a pair of shoulders 51 and a foot 52. A needle eye 53 is defined in the foot 52.

To assemble the board lock 50 into the groove 290, a space (not labeled) between a bottom surface of the guiding block 28 and an upper surface of the retention portion 29 accommodates a portion of the board lock 50. The shoulders 51 of the board lock 50 are seated upon the step 292 of the retention portion 29, and the foot 52 of the board lock 50 extends downwardly beyond the mounting face of the insulative housing 20 for being press fitted into corresponding plated through holes in the PCB.

The advantage of the present invention over the prior art is that the first and second contacts 30, 40 have the S-shaped bending portions 304, 404. Because of the S-shaped bending portions 304, 404 of the first, second contacts 30, 40, the height of the contacts and accordingly of the electrical connector 10 can be reduced sufficiently without reducing a length of the contact 30, 40, which is needed for giving the contacts 30, 40 sufficient bulk resistance to obtain the required impedance meeting a set value of an interconnecting system including the connector 10. Furthermore, because the first retention serrations 3031, 4031 protrude from a pair of sides the first mounting portion 303, 403 and the second retention serrations 3051, 4051 protrude from a pair of sides of the second contact portion 305, 405, the first and second contacts 30, 40 can be reliably retained in the housing 20. Therefore, the required performance of the connector 10 can be assured.

Alternatively but not shown in the drawings, the S-shaped bending portions 304, 404 may be formed any other crook shape to obtain the target reducing the height dimension of the contacts, without the necessity to reduce the length of the contacts. For example, N-shaped or Z-shaped bending portions or other shaped bending portions which firstly extend toward the mating face 21 and then bend downwardly to the mounting face 22, are also feasible.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base portion having a mounting face and a mating portion connecting with the base portion and having a mating face, a receiving slot defined between the mounting face and the mating face, a plurality of passageways defined in the housing and communicating with the receiving slot; and a plurality of contacts arranged in the passageways, each contact comprising a contact portion adapted for electrically engaging with a complementary connector, a first mounting portion fixed within the base portion, a second mounting portion offset from the first mounting portion and fixed to the base portion, a first bending portion extending from a top end of the first mounting portion toward the contact portion and a second bending portion bending portion sinusoidally extended from a bottom end of the first mounting portion in the offset direction and connecting with the second mounting portion, and a tail portion connecting with the second mounting portion, said tail portion being adapted for engaging with a printed circuit board.

2. The electrical connector as claimed in claim 1, wherein a pair of first retention serrations protrude from a pair of sides of the first mounting portion of the contact for engaging with the base portion of the housing reliably.

3. The electrical connector as claimed in claim 1, wherein a pair of second retention serrations protrude from a pair of sides of the second mounting portion of the contact for securely engaging with the base portion of the housing.

4. The electrical connector as claimed in claim 1, wherein each contact further includes a spring arm connecting the contact portion and the first mounting portion.

5. The electrical connector as claimed in claim 1, wherein the contact portion is a curved portion and comprises a free end resting on the housing.

6. The electrical connector as claimed in claim 1, wherein the contacts comprise first contacts and second contacts alternately arranged in the passageways.

7. The electrical connector as claimed in claim 6, wherein the bending portions of the first contacts and second contacts are respectively bent toward two opposite side walls of the housing.

8. The electrical connector as claimed in claim 1, further comprising a pair of board locks assembled into two lateral sides of the insulative housing for retaining the connector to the printed circuit board.

9. The electrical connector as claimed in claim 8, wherein the board locks each have a needle-eyed foot adapted for being press fitted into a plated through hole of the printed circuit board.

10. The electrical connector as claimed in claim 1, wherein the tail portion of the contact is a needle-eyed tail.

11. The electrical connector as claimed in claim 10, wherein the contacts comprise at least one grounding contact which has a tail portion longer than those of the other contacts.

12. The electrical connector as claimed in claim 11, wherein a distance between the contact portion of the at least one grounding contact and the mating face is shorter than a distance between the contact portions of the other contacts and the mating face.

13. The electrical connector as claimed in claim 12, wherein the needle-eyed tail of the contact comprises a pair of double supported cantilever beams adapted for functioning as the compliant zone for being pressed into a plated through hole in the printed circuit board.

14. A contact comprising:

a contact portion located on an upper end of the contact, a first mounting portion a second mounting portion offset from the first mounting portion, a first bending portion extending from top end to the first mounting portion toward the contact portion and a second bending portion sinusoidally extending from a bottom end of the first mounting portion in the offset direction and connecting with the second mounting portion, and a tail portion extending downwardly from the second mounting portion.

15. The contact as claimed in claim 14, wherein a pair of first retention serrations protrude from a pair of sides of the first mounting portion.

16. The contact as claimed in claim 14, wherein a pair of second retention serrations protrude from a pair of sides of the second mounting portion.

17. The contact as claimed in claim 14, wherein the tail portion is a needle-eyed tail.

18. The contact as claimed in claim 17, wherein the needle-eyed tail consists of a pair of double supported cantilever beams.

19. An electrical connector comprising:

an insulative housing defining a plurality of passageways therein; and a plurality of contacts received in the housing, each of said contacts including a resilient contact portion, a first mounting portion to hold said contact portion in position, a tail portion with a second mounting portion at a top portion thereof to hold said tail portion in position, said contact portion and said tail portion being offset from each other in a horizontal direction, and a bending portion with an obliquely extending main portion connected between a bottom section of the first mounting portion and a top section of the second mounting portion; wherein the top section of the second mounting portion is higher than the bottom section of the first mounting portion along a lengthwise direction of each of said passageways.

* * * * *